US005965835A

United States Patent [19]

Gartz

[11] Patent Number: 5,965,835

[45] Date of Patent: Oct. 12, 1999

[54] APPARATUS FOR MONITORING THE LOADED OR UNLOADED CONDITION OF A FRONT LOADING WEAPON

[75] Inventor: Karl Gartz, Neuss, Germany

[73] Assignee: Rheinmetall W & M GmbH, Ratingen, Germany

[21] Appl. No.: 08/934,194

[22] Filed: Sep. 18, 1997

[30] Foreign Application Priority Data

Sep. 20, 1996 [DE] Germany ..... 196 38 572

[51] Int. Cl.[6] ..... G01L 23/08; F41F 1/06

[52] U.S. Cl. ..... 89/1.35; 89/6; 73/167

[58] Field of Search ..... 367/157; 42/1.01, 42/1.03, 1.05, 51, 84, 70.01; 89/6, 6.5, 1.3, 1.35; 73/167

[56] References Cited

U.S. PATENT DOCUMENTS

| | | | |
|---|---|---|---|
| 2,475,387 | 7/1949 | Golden | 73/167 |
| 3,024,453 | 3/1962 | Ransom . | |
| 3,552,053 | 1/1971 | Jarvis | 42/1.03 |
| 3,570,365 | 3/1971 | Bornand | 89/1.35 |
| 3,698,282 | 10/1972 | Albatys . | |
| 4,001,961 | 1/1977 | Johnson et al. | 42/1.03 |
| 4,100,691 | 7/1978 | Wicklund | 42/1.05 |
| 4,541,191 | 9/1985 | Morris et al. | 42/1.03 |
| 4,793,085 | 12/1988 | Surawski et al. | 42/84 |
| 4,850,229 | 7/1989 | Phillips | 73/756 |
| 5,406,730 | 4/1995 | Sayre | 42/1.02 |
| 5,459,696 | 10/1995 | Dovrat et al. . | |

FOREIGN PATENT DOCUMENTS

| | | |
|---|---|---|
| 0 554 905 | 8/1993 | European Pat. Off. . |
| 883449 | 7/1943 | France . |
| 32 39 093 | 4/1984 | Germany . |

*Primary Examiner*—Charles T. Jordan
*Assistant Examiner*—Christopher K. Montgomery
*Attorney, Agent, or Firm*—Venable; Gabor J. Kelemen

[57] ABSTRACT

A front loading weapon includes a barrel for firing ammunition therefrom; a breechblock arranged at a rear terminal portion of the barrel; a firing pin carried by the breechblock; and an apparatus for monitoring load conditions of the barrel. The apparatus includes a body sound sensor mounted on the weapon and emitting a first signal representing body oscillations of the weapon; an electronic evaluating device connected to an output of the sensor for emitting a second signal characteristic of an impacting of a cartridge on a region of the breechblock upon loading the cartridge into the barrel; and a warning device connected to the electronic evaluating device for being actuated by the second signal.

6 Claims, 3 Drawing Sheets

APPARATUS FOR MONITORING THE LOADED OR UNLOADED CONDITION OF A FRONT LOADING WEAPON

BACKGROUND OF THE INVENTION

This invention relates to an apparatus for monitoring the condition (loaded or empty) of a front loading weapon having a weapon barrel provided with a breechblock.

Large-caliber front loading weapons such as mortars generally do not have a safety arrangement against dual loading. This poses a significant safety hazard for the weapon crew because upon firing of a dual charge the mortar barrel may burst. Further, risks are significant that upon placing the second mortar cartridge into the barrel, the first-loaded cartridge is fired and collides with the second cartridge (situated immediately in the zone of the barrel muzzle) and thus an explosion occurs.

SUMMARY OF THE INVENTION

It is an object of the invention to provide an apparatus for monitoring the loading process of a front-loading weapon in a simple and automatic manner.

This object and others to become apparent as the specification progresses, are accomplished by the invention, according to which, briefly stated, the front loading weapon includes a barrel for firing ammunition therefrom; a breechblock arranged at a rear terminal portion of the barrel; a firing pin carried by the breechblock; and an apparatus for monitoring load conditions of the barrel. The apparatus includes a body sound sensor mounted on the weapon and emitting a first signal representing body oscillations of the weapon; an electronic evaluating device connected to an output of the sensor for emitting a second signal characteristic of an impacting of a cartridge on a region of the breechblock upon loading the cartridge into the barrel; and a warning device connected to the electronic evaluating device for being actuated by the second signal.

Essentially, the invention is based on the principle to measure, by means of a suitable sensor, the body sound signals generated when the cartridge abuts the breechblock or the firing pin, and to evaluate the signals in an electronic evaluating device. As a result of such an evaluation, the evaluating device then generates signals for actuating a warning lamp or a setting device for a mechanical lock which prevents a second loading of the weapon.

The body sound sensor is preferably mounted at the breechblock end of the barrel, for example, on the base plate of a mortar since it has been found that by placing the sensor in such a zone, signals particularly characteristic of the impacting of the cartridge on the firing pin may be derived from the frequency spectrum of the measured sensor signals.

DESCRIPTION OF THE PREFERRED EMBODIMENT

Figure 1:
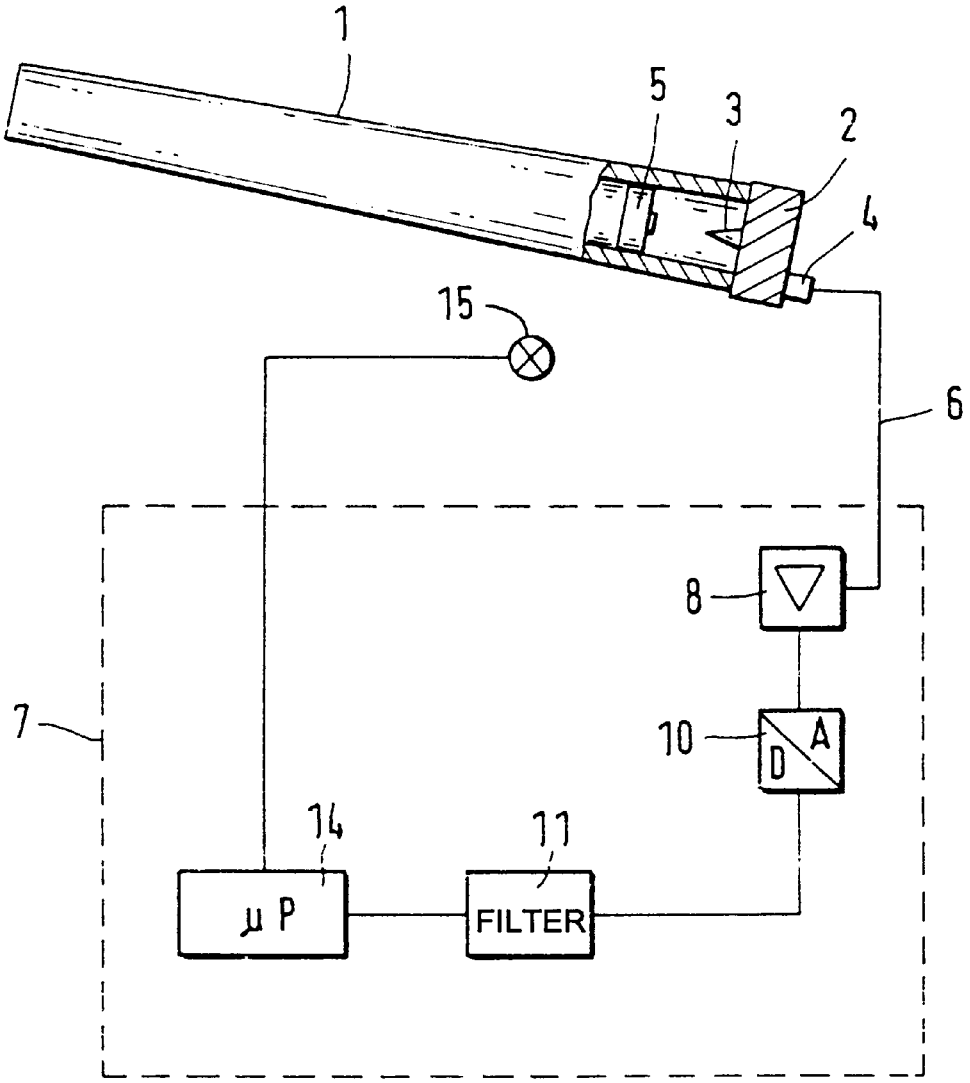
FIG. 1 illustrates a weapon barrel including a body sound sensor connected with an evaluating apparatus illustrated in block diagram form.

FIG. 1 shows a weapon barrel 1 of a front loading weapon (mortar) which is provided with a breechblock 2 carrying a firing pin 3. To the breechblock 2 a piezoelectric acceleration sensor 4 is secured for measuring body sound oscillations generated when the base of a cartridge 5 abuts the firing pin 3 as the cartridge 5 is lowered into the barrel 1. The acceleration sensor 4 is connected to an electronic evaluating device 7 by an electric conductor 6.

Figure 2:
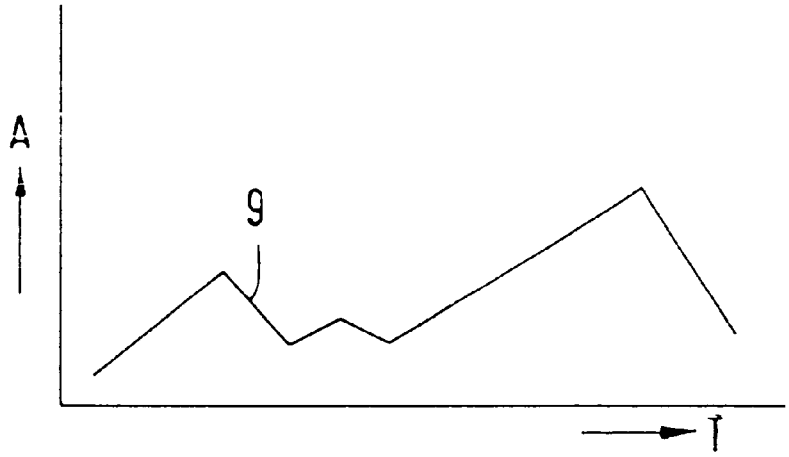
FIG. 2 is a diagram illustrating the course of a sensor signal curve.

The evaluating device 7 includes an input amplifier 8 for amplifying the signal generated by the sensor 4. The amplified signal 9 (shown in FIG. 2) is applied to an analog/digital converter 10 connected to an output of the amplifier 8 and is digitalized therein and thereafter applied to a digital frequency filter 11.

Figure 3:
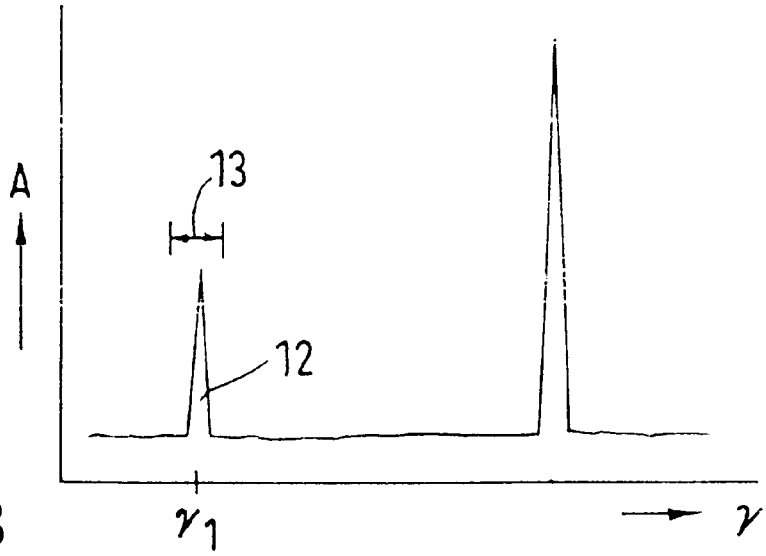
FIG. 3 is a diagram illustrating an idealized frequency spectrum of the sensor signal shown in FIG. 2.

The frequency range of the digital filter 11 is selected such that only those frequency portions of the measuring signal 9 are passed which are characteristic of the colliding of the cartridge 5 with the firing pin 3. In FIG. 3, showing a coordinate system having an amplitude ordinate A and a frequency abscissa $\gamma$, the signal value characteristic of the impacting is designated at 12 and the corresponding frequency range to be analyzed is designated at 13. The signal 12 has its peak at a frequency $\gamma_1$.

The digital signal values obtained at the output of the frequency filter 11 are thereafter converted by a microprocessor 14 into setting signals, for example, for actuating a lamp 15 which signals the weapon crew that the weapon barrel 1 already contains ammunition.

Figure 1A:
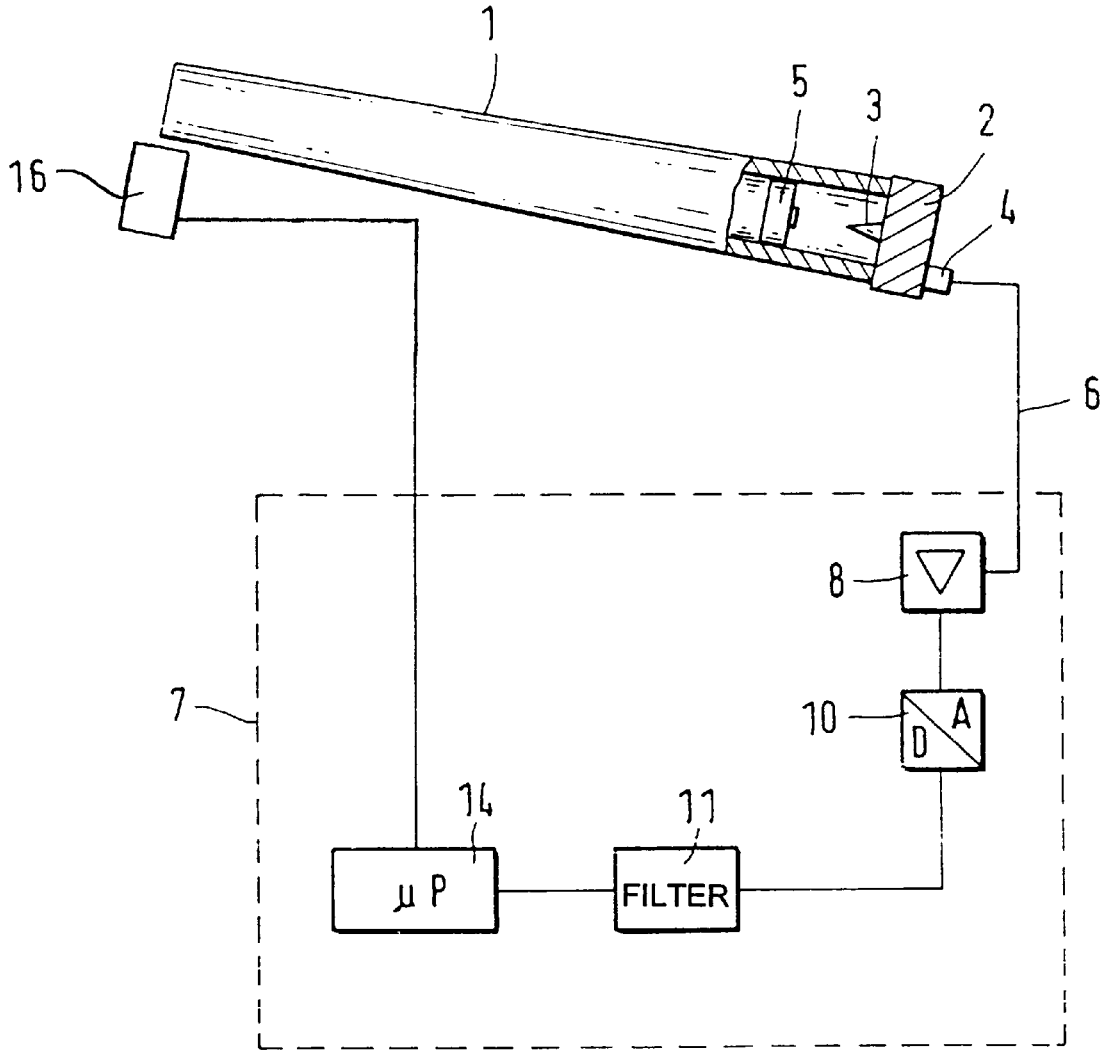
FIG. 1A which is similar to FIG. 1, illustrates a variant.

As an alternative of, or in addition to the signaling lamp 15, the microprocessor 14 may be connected to a mechanical barrel lock symbolically shown at 16 in FIG. 1A. Upon receipt of a signal from the microprocessor 14, the lock 16 assumes a closed position in which it prevents loading of a cartridge into the barrel 1.

It will be understood that the above description of the present invention is susceptible to various modifications, changes and adaptations, and the same are intended to be comprehended within the meaning and range of equivalents of the appended claims.

What is claimed is:

1. A front loading weapon comprising (a) a barrel for firing ammunition therefrom;

(b) a breechblock arranged at a rear terminal portion of said barrel;

(c) a firing pin carried by said breechblock; and (d) an apparatus for monitoring a presence of a cartridge in said barrel; said apparatus including (1) a body sound sensor mounted on the weapon for detecting an acoustic signal generated when said cartridge impacts with a region of said breechblock upon loading said cartridge in said barrel and for emitting a first signal representing said acoustic signal;

(2) an electronic evaluating device connected to an output of the sensor for emitting a second signal representing said first signal; and (3) a warning device connected to said electronic evaluating device for being actuated by said second signal.

2. The front loading weapon as defined in claim 1, wherein said sensor is mounted on said breechblock.

3. The front loading weapon as defined in claim 1, further comprising a mechanical barrel lock having an open position allowing loading of a cartridge into the barrel and a closed position preventing loading of a cartridge into the barrel; said barrel lock being connected to said electronic evaluating device for being placed into said closed position by said second signal.

4. The front loading weapon as defined in claim 1, wherein said sensor comprises a piezoelectric acceleration sensor.

5. The front loading weapon as defined in claim 1, wherein said evaluating device includes (a) means for determining a frequency spectrum of said first signal in a predetermined frequency range; and (b) means for processing amplitude values, appearing in said predetermined frequency range, as signal values characteristic of an impacting of the cartridge on a region of said breechblock.

6. The front loading weapon as defined in claim 1, wherein said region of said breechblock is said firing pin.

* * * * *

UNITED STATES PATENT AND TRADEMARK OFFICE

CERTIFICATE OF CORRECTION

PATENT NO. : 5,965,835
DATED : October 12, 1999
INVENTOR(S) : Karl Gartz

It is certified that error appears in the above-identified patent and that said Letters Patent is hereby corrected as shown below:

On the title page, item [22], Filed: the date should read: --September 19, 1997--.

Signed and Sealed this

Twenty-eighth Day of November, 2000

*Attest:*

*Attesting Officer*

Q. TODD DICKINSON

*Director of Patents and Trademarks*